US008490445B2

(12) United States Patent
Chiou et al.

(10) Patent No.: US 8,490,445 B2
(45) Date of Patent: Jul. 23, 2013

(54) ELECTRIC DOOR LOCK

(75) Inventors: Ming-Shyang Chiou, Chiayi (TW); Chia-Min Sun, Chiayi (TW); Yu-Ting Huang, Chiayi (TW); Yu-Le Lin, Yunlin County (TW)

(73) Assignee: Tong Lung Metal Industry Co., Ltd., Chia-Yi (TW)

( * ) Notice: Subject to any disclaimer, the term of this patent is extended or adjusted under 35 U.S.C. 154(b) by 315 days.

(21) Appl. No.: 12/855,411

(22) Filed: Aug. 12, 2010

(65) Prior Publication Data

US 2011/0036131 A1 Feb. 17, 2011

(30) Foreign Application Priority Data

Aug. 13, 2009 (TW) ..... 98214932 U
Dec. 14, 2009 (TW) ..... 98223404 U

(51) Int. Cl.
*E05B 47/00* (2006.01)

(52) U.S. Cl.
USPC ..... 70/279.1; 70/224; 70/277; 70/472

(58) Field of Classification Search
USPC ..... 70/149, 188, 189, 218, 223, 224, 70/277, 278.1, 278.7, 279.1, 280, 281, 282, 70/422, 472
See application file for complete search history.

(56) References Cited

U.S. PATENT DOCUMENTS

| | | | | |
|---|---|---|---|---|
| 6,471,257 | B1 * | 10/2002 | Lu et al. | 70/280 |
| 6,517,127 | B1 * | 2/2003 | Lu et al. | 70/280 |
| 6,807,834 | B2 * | 10/2004 | Tsai | 70/472 |
| 7,516,633 | B1 * | 4/2009 | Chang | 70/472 |
| 7,698,917 | B2 * | 4/2010 | Lie-Nielsen et al. | 70/143 |
| 7,770,423 | B2 * | 8/2010 | Wu | 70/218 |
| 7,827,837 | B2 * | 11/2010 | Huang et al. | 70/277 |
| 2004/0177660 | A1 * | 9/2004 | Tsai | 70/223 |
| 2009/0173120 | A1 * | 7/2009 | Lin et al. | 70/279.1 |
| 2010/0212381 | A1 * | 8/2010 | Huang et al. | 70/279.1 |
| 2011/0067464 | A1 * | 3/2011 | Chiou et al. | 70/278.7 |

* cited by examiner

*Primary Examiner* — Christopher Boswell
(74) *Attorney, Agent, or Firm* — Ladas & Parry LLP

(57) ABSTRACT

A door lock includes a first driven wheel connected drivenly to a motor and having two resilient driving elements, and a second driven wheel connected drivenly to a rotary handle and the first driven wheel. The second driven wheel has a driven element disposed between and driven by the driving elements so that the second driven wheel moves to a first or second position to place a latch bolt in a latching or unlatching position. When the latch bolt is jammed, the second driven wheel is inoperative. However, as the driving elements are resilient, the first driven wheel can continue its rotation without being obstructed.

22 Claims, 19 Drawing Sheets

ELECTRIC DOOR LOCK

CROSS-REFERENCE TO RELATED APPLICATION

This application claims priority of Taiwanese Utility Model Application Nos. 098214932 filed on Aug. 13, 2009, and 098223404 filed on Dec. 14, 2009.

BACKGROUND OF THE INVENTION

1. Field of the Invention

This application relates to a door lock, and particularly to an electronic door lock which functions both mechanically and electrically.

2. Description of the Related Art

Generally, the designs of door locks are directed towards simplicity, convenience, as well as enhancement for security. A mechanical door lock operated by a key is sometimes inconvenient because the user may not have the key in hand. Although an electric door lock operated electrically is relatively convenient, it will be inoperative in case of power shortages. For efficiency purposes, electric door locks that function mechanically and electrically have been developed. Examples of such electric door locks are disclosed in US Publication Nos. 20070169525 and 20030209042. However, when a latch bolt of such an electric door lock is jammed, a motor to operate the latch bolt will malfunction.

SUMMARY OF THE INVENTION

An object of the present invention is to provide an electric door lock with a simple construction that functions mechanically and electrically.

Another object of the present invention is to provide an electric door lock with a construction that permits a motor to work without malfunctioning even when a latch bolt is jammed inside or outside a latch hole.

According to one aspect of the present invention, an electric door lock comprises: a drive unit having a motor; a first driven wheel connected drivenly to the drive unit; a spring attached to the first driven wheel and having two angularly spaced apart resilient driving elements; a latch unit; an operating unit to operate the latch unit and having a rotary handle; and a second driven wheel connected drivenly to the operating unit and the first driven wheel. The second driven wheel has a driven element extending to the first driven wheel and disposed between the driving elements so as to be pushed by one of the driving elements. The second driven wheel element is movable between a first position that places the latch unit in an unlatching position and a second position that places the latch unit in a latching position. One of the driving elements pushes the driven element to move the second driven wheel from the first position to the second position. The other one of the driving elements pushes the driven element to move the second driven wheel from the second position to the first position.

According to another aspect of the present invention, an electric door lock comprises: an electric drive unit having a motor; a first driven wheel connected drivenly to the motor, and having at least one resilient driving element; a latch unit; an operating unit to operate the latch unit and having rotary handle; and a second driven wheel connected drivenly to the rotary handle and the first driven wheel. The second driven wheel has a driven element driven by the driving element.

The driving element causes the second driven wheel and the driven element to rotate in a first angular direction when the first driven wheel is rotated in the first angular direction. The driving element is rotatable resiliently relative to the first driven wheel in a second angular direction opposite to the first angular direction when the first driven wheel rotates in the first angular direction and when the second driven wheel and the driven element are inoperative to rotate.

Preferably, the first driven wheel further has at least one abutment face, and a spring that is attached to the first driven wheel and that has an end portion acting as the resilient driving element. The end portion abuts against the abutment face by a biasing force of the spring. The end portion is separable from the abutment face when the driven element cannot be rotated by the end portion of the spring.

According to still another aspect of the present invention, an electric door lock comprises: a drive unit having a motor; a first driven wheel that is connected drivenly to the drive unit, has a driving element, and is rotatable between an original position and a final position; a latch unit; an operating unit to operate the latch unit and having a rotary handle; a second driven wheel connected drivenly to the rotary handle and the first driven wheel. The second driven wheel has a driven element to be moved by the driving element. The second driven wheel is movable between a first position that places the latch unit in an unlatching position and a second position that places the latch unit in a latching position.

The electric door lock further comprises an electronic control unit connected electrically to the motor, and having a first sensor switch proximate to the first driven wheel to detect varying positions of the first driven wheel, and a second sensor switch proximate to the second driven wheel to detect varying positions of the second driven wheel. The first driven wheel rotates between the original and final positions when the second driven wheel moves between the first and second positions. The electronic control unit activates or deactivates the motor based on a detected signal of the first sensor switch, and controls the rotation direction of the motor based on a detected signal of the second sensor switch.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
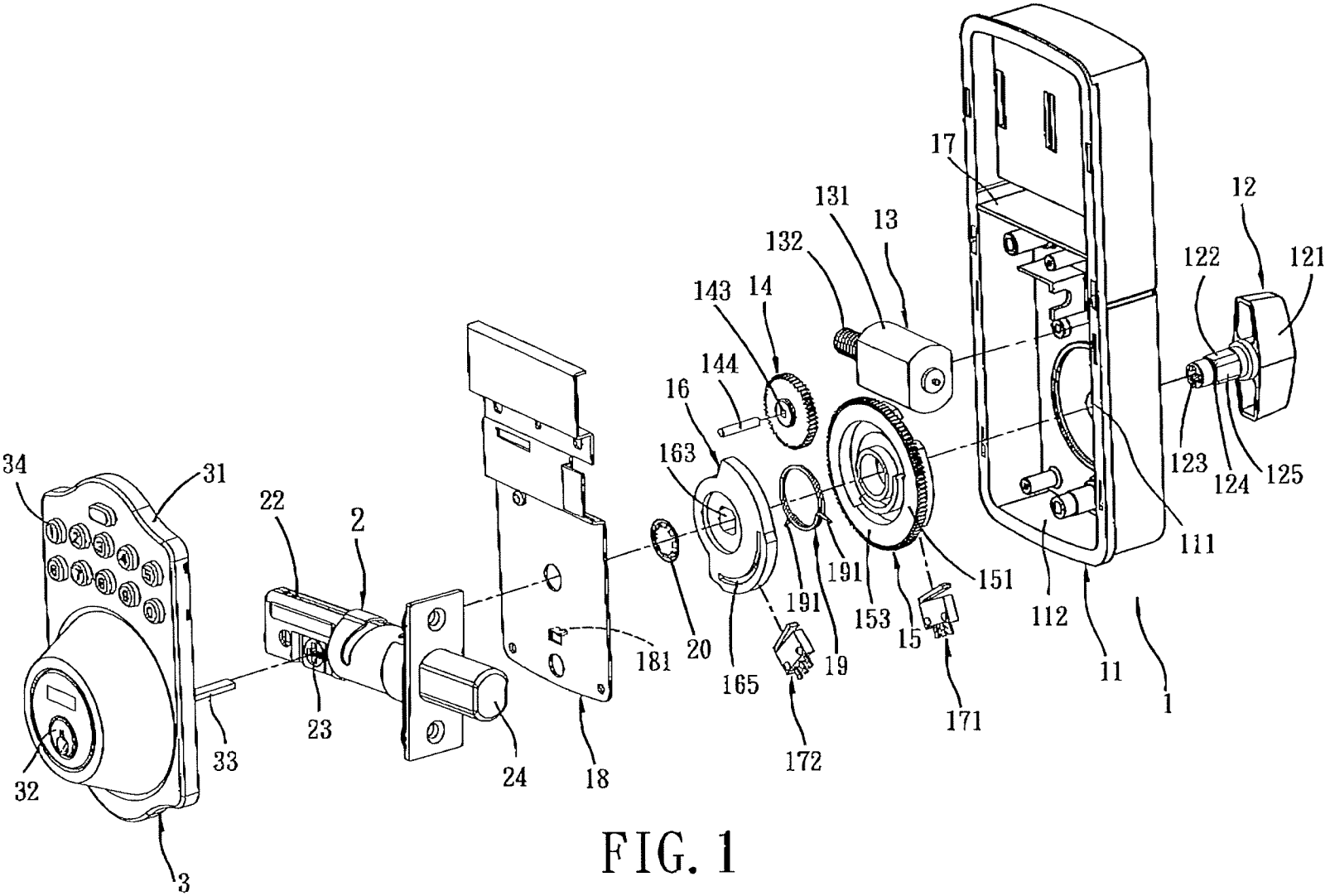
FIG. 1 is an exploded view of an electric door lock according to a first preferred embodiment of the present invention.

Before the present invention is described in greater detail, it should be noted that same reference numerals have been used to denote like elements throughout the specification.

Referring to FIG. 1, an electric door lock according to a first preferred embodiment of the present invention includes a housing 11, an operating unit 12, a drive unit 13, a drive wheel 14, a first driven wheel 15, a second driven wheel 16, a spring 19, an electronic control unit 17, and a frame 18.

The housing 11 has a through hole 111 and a receiving space 112.

The operating unit 12 has a rotary handle 121 and a spindle part 122 which extends into the receiving space 112 through the through hole 111. The spindle part 122 has a polygonal cross-section, such as a substantially rectangular cross-section and is formed with a cross-shaped central bore 123, and an annular groove 124.

The drive unit 13 is mounted within the receiving space 112 and includes a reversible motor 131, and a worm 132.

Figure 2:
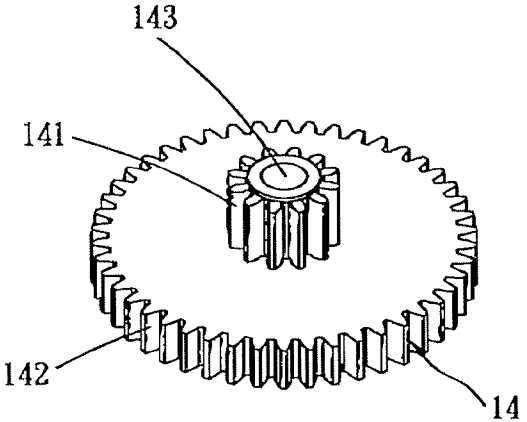
FIG. 2 is a perspective view of a drive wheel of the electric door lock of FIG. 1.

Referring to FIG. 2 in combination with FIG. 1, the drive wheel 14 has a small gear 141 integral with a large gear 142 which is meshed with the worm 132 for speed reduction. A spindle 144 is journalled in a central hole 143 of the drive wheel 14 so that the drive wheel 14 is rotatable within the receiving space 112.

Figure 3:
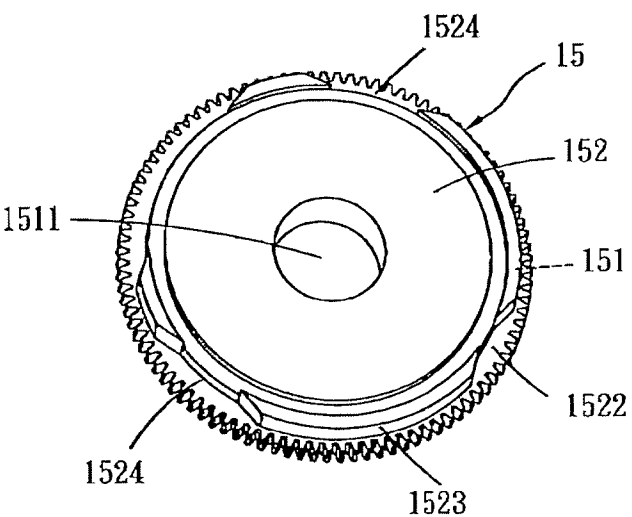
FIG. 3 is a perspective view of a first driven wheel of the electric door lock of FIG. 1.
Figure 4:
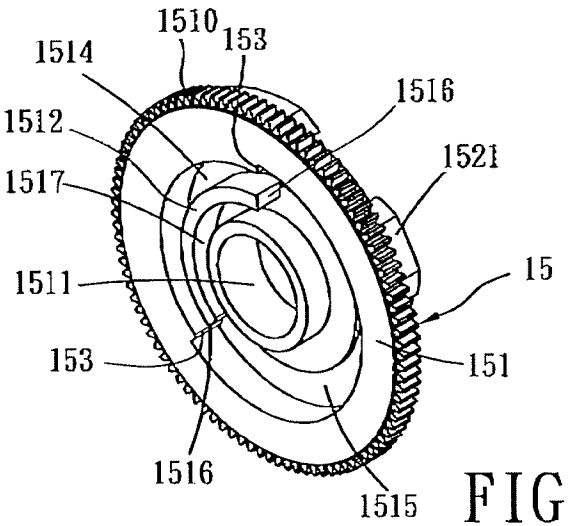
FIG. 4 is another perspective view of the first driven wheel.

Referring to FIGS. 3 & 4 in combination with FIG. 1, the first driven wheel 15 is driven by the drive wheel 14 and includes opposite first and second faces 151, 152, a central hole 1511 extending through the first and second faces 151, 152, gear teeth 1510 formed on a peripheral portion of the first driven wheel 15 adjacent to the first face 151. The gear teeth 1510 are meshed with the small gear 141 of the drive wheel 14 for speed reduction. The first face 151 is recessed to form an annular recess 1515 around the central hole 1511. An arc-shaped rib 1512 is formed within the annular recess 1515, and divides a portion of the annular recess 1515 into first and second arc-shaped grooves 1514, 1517. Two angularly spaced apart opposite ends of the arc-shaped rib 1512 are used as abutment faces 1516 for the spring 19 which will be described hereinafter. Shoulder faces 153 formed on a rib adjacent to the first arc-shaped groove 1514 may also be used as abutment faces for the spring 19.

The first driven wheel 15 further includes first and second cutouts 1522, 1524 formed circumferentially at different angular positions around the second face 152. An arcuate projection 1523 is formed between the first and second cutouts 1522, 1524.

The spring 19 is a coiled or torsion spring and is disposed within the annular recess 1515 and the second arc-shaped groove 1517. The spring 19 is disposed around the central hole 1511 and has two end portions 191 that are bent to extend radially and outwardly and that respectively abut against the two abutment faces 1516. The arc-shaped rib 1512 and the first arc-shaped groove 1514 are disposed between the end portions 191. While the torsion spring is used in this embodiment, the present invention should not be limited only thereto. A compression spring or other spring may be used in place of the torsion spring.

Figure 5:
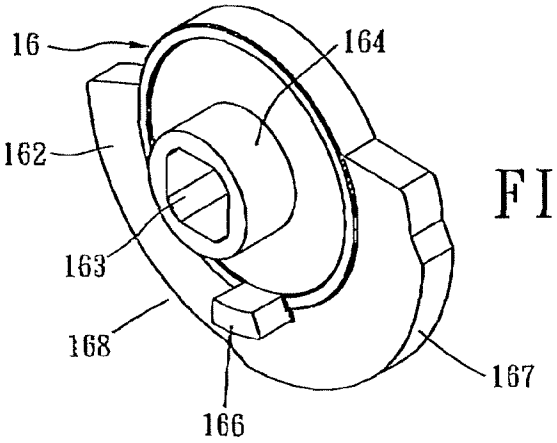
FIG. 5 is a perspective view of a second driven wheel of the electric door lock of FIG. 1.
Figure 6:
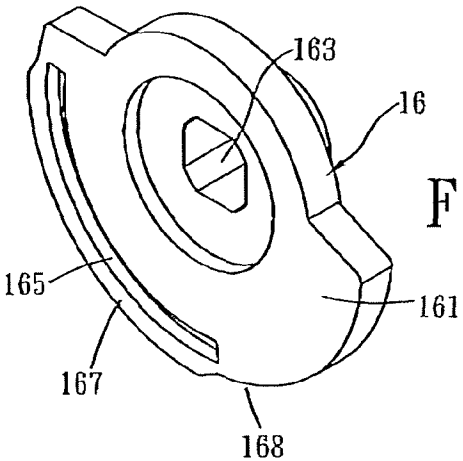
FIG. 6 is another perspective view of the second driven wheel.

Referring to FIGS. 5 & 6 in combination with FIG. 1, the second driven wheel 16 includes opposite first and second end faces 161, 162, a central hole 163 extending through the first and second end faces 161, 162, and a block 166 and a tubular protrusion 164 protruding from the second end face 162. The tubular protrusion 164 projects into the central hole 1511 of the first driven wheel 15. The block 166 extends slidably into the first arc-shaped groove 1514. The central hole 163 is substantially rectangular and receives fittingly the spindle portion 122 of the operating unit 12, thereby connecting the rotary handle 121 to the second driven wheel 16 for simultaneous rotation. A retaining ring 20 is fixed in the annular groove 124 in the rotary handle 121 to limit axial movement of the second driven wheel 16.

The second driven wheel 16 further includes an arcuate projection 167 and an arcuate cutout 168 formed circumferentially on the periphery of the second driven wheel 16 at different angular positions. An arcuate recess 165 is formed in the first end face 161 of the second driven wheel 16.

Figure 7:
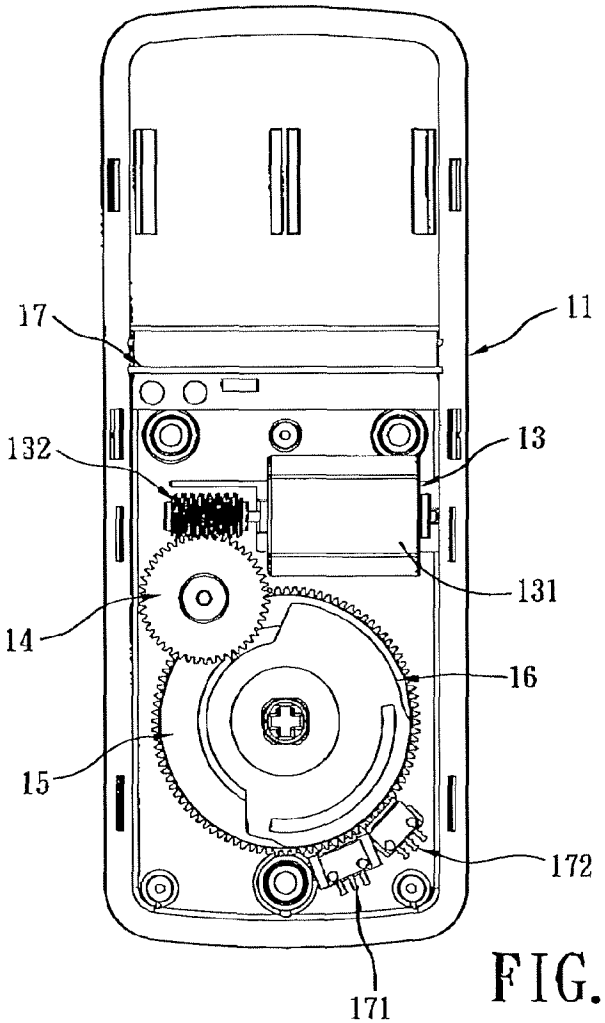
FIG. 7 is an elevation view showing the drive wheel and the first and second driven wheels in an assembled state.

Referring to FIG. 7 in combination with FIG. 1, the electronic control unit 17 includes first and second sensor switches 171, 172 which are disposed inside the housing 11, and a control circuit (not shown) connected electrically to the first and second sensor switches 171, 172. The first sensor switch 171 is used to control activation and deactivation of the motor 131, and the second sensor switch 172 is used to control clockwise and counterclockwise rotational movements of the motor 131. In this embodiment, the first and second cutouts 1522, 1524 and the arcuate projection 1523 of the first driven wheel 15 are used as first, second, and third sensing elements to be detected by the first sensor switch 171. The arcuate projection 167 and the arcuate cutout 168 of the second driven wheel 16 are used as fourth and fifth sensing elements to be detected by the second sensor switch 172.

During the rotation of the first driven wheel 15, the first sensor switch 171 will detect the first cutout 1522, the arcuate projection 1523, and the second cutout 1524 consecutively to produce three successive signals so that the electronic control unit 17 will activate or deactivate the motor 131. When the first and second cutouts 1522, 1529 register with the first sensor switch 171, the first sensor switch 171 is not pressed so that the motor 131 stops its rotation. When the arcuate projection 1523 is registered with the first sensor switch 171, the first sensor switch 171 is pressed, and the motor 131 is activated to rotate.

On the other hand, the second sensor switch 172 serves to detect the arcuate projection 167 and the arcuate cutout 168. When the second sensor switch 172 is pressed by the arcuate projection 167, the motor rotates in one direction. When the second sensor switch 172 is registered with but not pressed by the arcuate cutout 168, the motor 131 rotates in an opposite direction.

The frame 18 is attached to the housing 11 to cover a portion of the receiving space 112 of the housing 11. The frame 18 has a limit member 181 that projects into the arcuate recess 165 of the second driven wheel 16 to limit angular displacement of the second driven wheel 16. After the frame 18 is assembled with the housing 11, the assembly can be mounted inside a door panel (not shown).

Referring back to FIG. 1, the electric door lock further includes an outside lock unit 3 which has a cover disc 31, a key-operated lock 32 and a controller input unit 34 which is a key set. Alternatively, the key set may be replaced by another input unit, such as a finger print identifying device, or a remote control unit. The controller input unit 34 is connected electrically to the electronic control unit 17.

The key-operated lock 32 is coupled to an actuating plate 33 which extends through a cross slot 23 of a driving mechanism 22 of the latch unit 2, and a central bore 123 in the rotary handle 121. Accordingly, the key-operated lock 32 can operate the latch bolt 24 through the actuating plate 33 to move to a latching position or an unlatching position.

Figure 9:
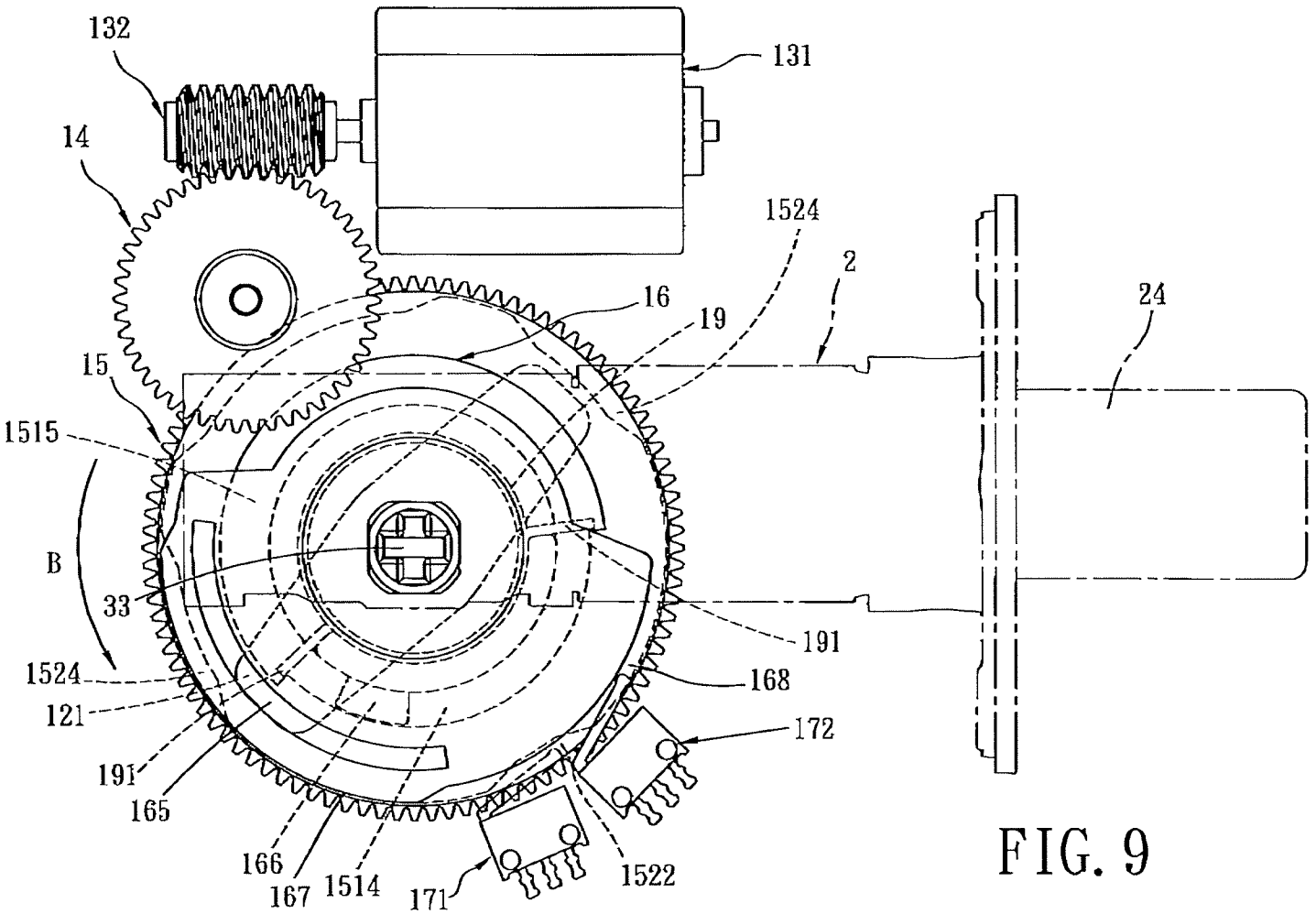
FIG. 9 shows that the driven element is in its second position, the latch bolt is in its latching position, and the first driven wheel is in its original position.
Figure 10:
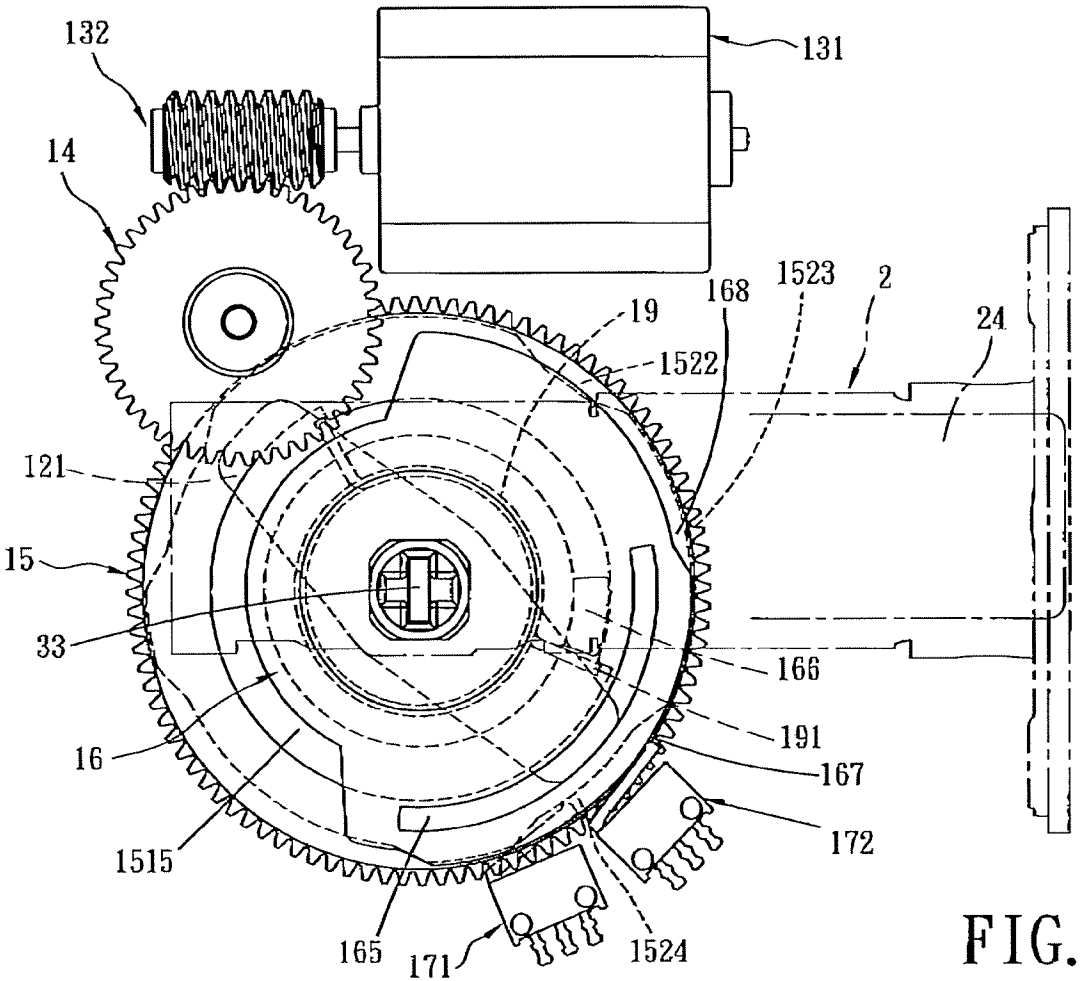
FIG. 10 shows that the driven element of the second driven wheel is in its first position, the latch bolt is in its unlatching position, and the first driven wheel is in its final position.

Referring back to FIG. 1, the second driven wheel 16 is connected to the first driven wheel 15 and is driven by the first driven wheel 15. In particular, the end portions 191 of the spring 19 are used as driving elements of the first driven wheel 15, and the block 166 is used as a driven element for the second driven wheel 16. The driven element or the block 166 is movable between a first position (FIG. 8) that places the latch bolt 24 in an unlatching position and a second position that places the latch bolt 29 in a latching position (FIG. 9). One of the end portions 191 pushes the driven element or the block 166 from the first position to the second position. The other end portion 191 pushes the block 166 from the second position to the first position. The first driven wheel 15 rotates between an original position and a final position when the second driven wheel 16 moves between the first and second positions thereof. The first driven wheel 15 reaches its original position when the first sensor switch 171 is registered with and detects the first cutout 1522 (FIG. 8), and its final position when the first sensor switch 171 registers with and detects the second cutout 1529 (FIG. 10).

Referring back to FIGS. 1, 8 and 9, the electric door lock is operated to move the latch bolt 24 from an unlatching position (FIG. 8) to a latching position (FIG. 9) by rotating the rotary handle 121 in clockwise (direction (A) in FIG. 8). The first driven wheel 15 is not rotated at this state. But the second driven wheel 16 is rotated from its first position shown in FIG. 8 to its second position shown in FIG. 9 so that the block 166 slides within the first arc-shaped groove 1514 from the position (FIG. 8) to the position (FIG. 9). Because the actuating plate 33 is coupled with the rotary handle 121 and the second driven wheel 16, the actuating plate 33 drives the latch bolt 24 of the latch unit 2 to the latching position as shown in FIG. 9.

When the rotary handle 121 is rotated counterclockwise (direction (B) shown in FIG. 9), the block 166 of the second driven wheel 16 slides within the first arc-shaped groove 1514 from the second position (FIG. 9) to the first position (FIG. 8), and the latch bolt 24 is moved to the latching position (FIG. 8) from the unlatching position (FIG. 9.)

Figure 8:
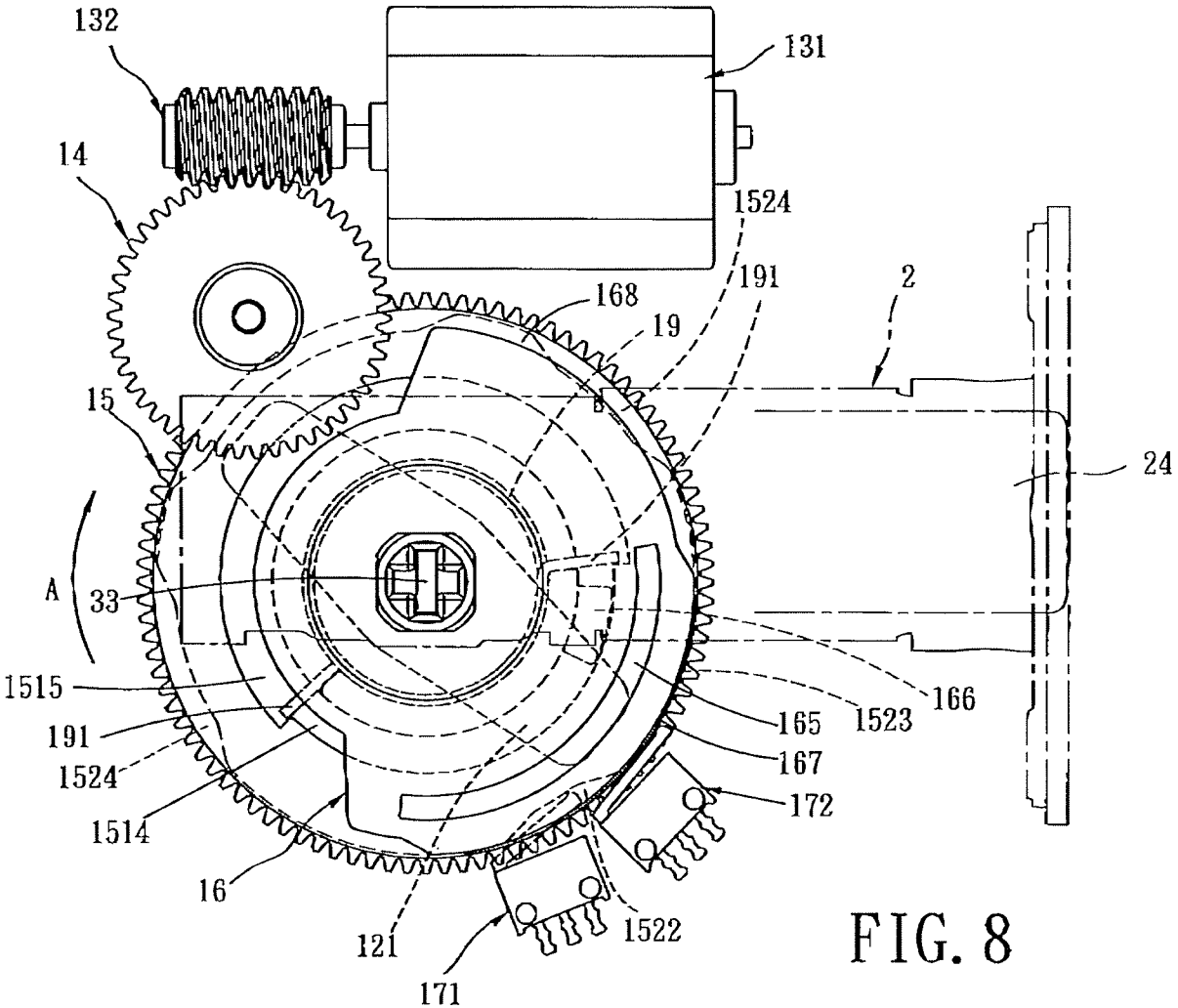
FIG. 8 is a schematic view illustrating that the driven element of the second driven wheel is in its first position, the latch bolt is in its unlatching position, and the first driven wheel is in its original position.
Figure 11:
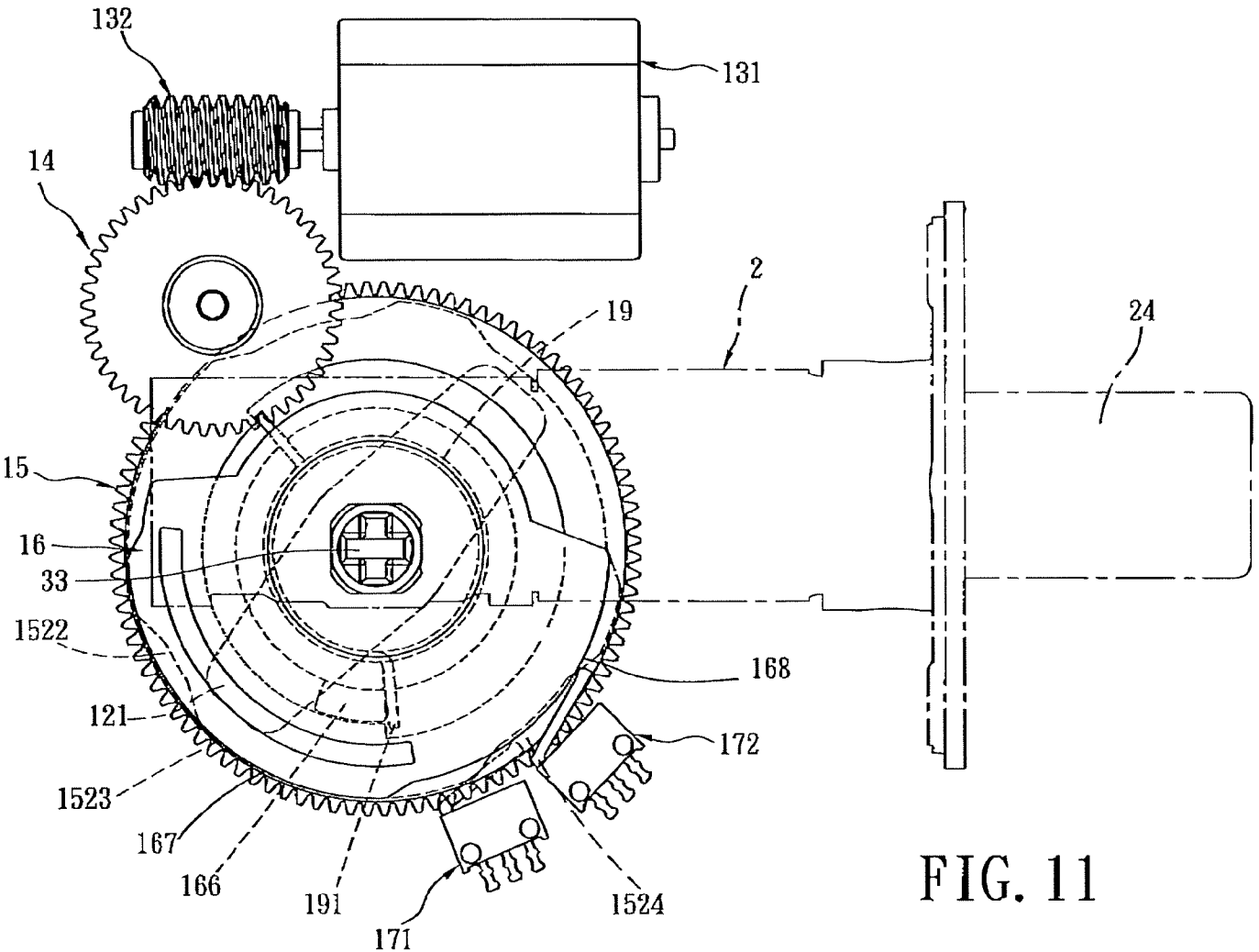
FIG. 11 shows that the driven element is in its second position, the latch bolt is in its latching position, and the first driven wheel is in its final position.

Referring to FIG. 11 in combination with FIGS. 1 and 8, the latch bolt 24 is moved from the unlatching position (FIG. 8) to the latching position (FIG. 11) by operating the controller input unit (the key set) 34 (FIG. 1) so that the electronic control unit 17 activates the motor 131. Accordingly, the first driven wheel 15 rotates in the clockwise direction (A) from its original position so that one of the end portions 191 is moved in a direction towards the block 166. During the rotation of the first driven wheel 15, as the arcuate projection 1523 of the first driven wheel 15 is in contact with the first sensor switch 171, the motor 131 is activated to rotate the first driven wheel 15 continuously. Therefore, the block 166 is pushed by the end portion 191 that moves to the block 166, thereby rotating the second driven wheel 16 clockwise and moving the second cutout 1524 of the first driven wheel 15 to the first sensor switch 171 as shown in FIG. 11. When the first sensor switch 171 is aligned with the second cutout 1524, the electronic control unit 17 deactivates the motor 131, the first driven wheel 15 stops at its final position, and the latch bolt 24 reaches its latching position. After the latch bolt 24 reaches the latching position, the electronic control unit 17 controls the motor 131 to reverse the rotation direction thereof so that the first driven wheel 15 rotates counterclockwise and moves back to its original position where the first cutout 1522 is aligned with the first sensor switch 171 (FIG. 8).

The latch bolt 24 may also be moved to its unlatching position (FIG. 10) from its latching position (FIG. 9) by operating the controller input unit 34 (FIG. 1) to activate the motor 131 and to thereby rotate the first driven wheel 15 counterclockwise (direction B).

Figure 12:
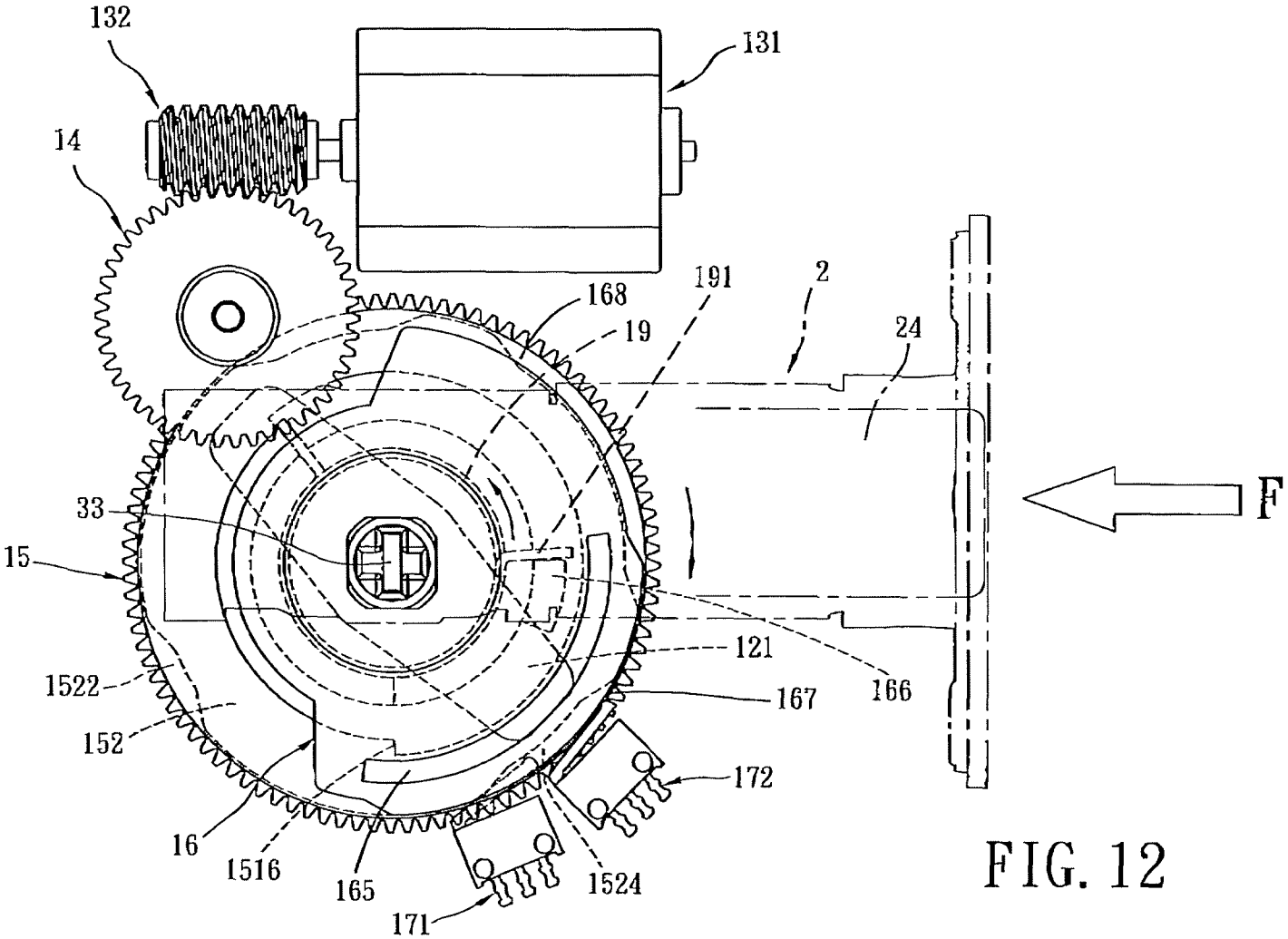
FIG. 12 shows that the latch bolt is subjected to an obstruction force and cannot move to its latching position during the operation of the electric door lock through a motor.
Figure 13:
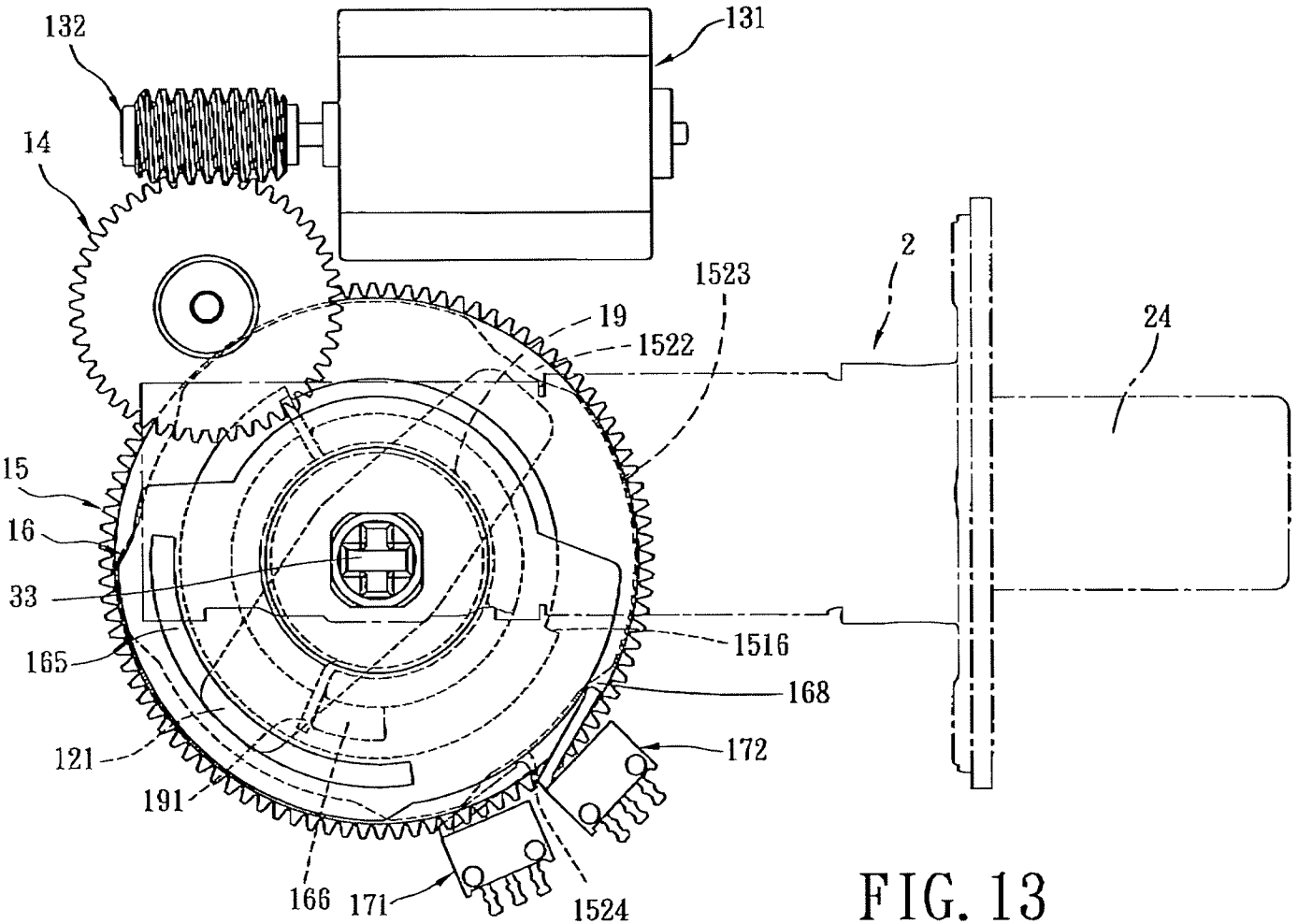
FIG. 13 shows that the latch bolt is subjected to an obstruction force and cannot move to its unlatching position during the operation of the electric door lock through the motor.

Referring to FIGS. 12 and 13, when the latch bolt 24 is jammed due to an obstruction force such as a force (F) that obstructs the latch bolt 24 from moving to its latching position, or when the latch bolt 24 gets stuck in a latch hole (not shown) and cannot move to its unlatching position, the electric door lock of the present invention permits the drive unit 13 or the motor 131 to operate normally without malfunctioning. As shown in FIGS. 1 and 8, the electronic control unit 17 is operated through the controller input unit (key set) 34 to activate the motor 131 to thereby rotate clockwise (direction A) the first driven wheel 15 which is at its original position, and one of the end portions 191 pushes the block 166 of the second driven wheel 16. If the latch bolt 24 is jammed and cannot move to its latching position due to the obstruction force (F) as shown in FIG. 12, the actuating plate 33, the second driven wheel 16 and the block 166 will not rotate during the clockwise rotation of the first driven wheel 15. However, because the end portion 191 is resiliently movable relative to the first driven wheel 15 in an angular direction opposite to a rotation direction of the first driven wheel 15, when the end portion 191 is limited from rotating clockwise by the block 166 which is not rotatable, the end portion 191 of the spring 19 permits the first driven wheel 15 to rotate clockwise without being obstructed. On the other hand, as the abutment face 1516 rotates clockwise together with the first driven wheel 15, the abutment face 1516 is moved away from the end portion 191, as shown in FIG. 12. Rotation of the first driven wheel 15 stops when the first sensor switch 171 is registered with and is not pressed by the second cutout 1524. At this state, as the arcuate projection 167 constantly contacts the second sensor switch 172, the second sensor switch 172 does not detect the arcuate cutout 168 or any positional change of the second driven wheel 16, and the latch bolt 24 does not move to its latching position. As a result, the electronic control unit 17 generates an error or alarm signal in terms of an audio or video signal to notify the user that the latch bolt 24 did not move to the latching position or that the first driven wheel 15 must rotate counterclockwise to move to its original position where the first cutout 1522 is aligned with the first sensor switch 171.

Referring back to FIGS. 1 and 9, when the first driven wheel 15 is rotated counterclockwise (direction B) from its original position to move the latch bolt 24 from the latching position to the unlatching position, one of the end portions 191 pushes the block 166 of the second driven wheel 16. If the latch bolt 24 is jammed and cannot move to its unlatching position as shown in FIG. 13, the actuating plate 33, the second driven wheel 16 and the block 166 will not rotate during the counterclockwise rotation of the first driven wheel 15. In this case, the first driven wheel 15 is also permitted to rotate counterclockwise without being obstructed. Rotation of the first driven wheel 15 stops when the first sensor switch 171 is registered with and not pressed by the second cutout 1524. At this state, as the arcuate cutout 168 is aligned with the second sensor switch 172, the second sensor switch 172 does not detect the arcuate projection 167 or any positional change of the second driven wheel 16, and the latch bolt 24 does not move to its unlatching position. As a result, the electronic control unit 17 generates an error signal to notify the user that the latch bolt 24 did not move to its unlatching position or that the first driven wheel 15 must rotate clockwise to move to its original position where the first cutout 1522 is aligned with the first sensor switch 171.

The lengths of the first and second cutouts 1522 and 1524 of the first driven wheel 15 are determined by the signals to be produced thereby. When the first driven wheel 15 rotates from the original position where the first cutout 1522 registers with the first sensor switch 171 to the final position where the second cutout 1524 registers with the first sensor switch 171, the first sensor switch 171 is released and produces a signal for deactivating the motor 131. However, after deactivation, the motor 131 can rotate a short distance further due to its inertia. Therefore, a longer length is needed for the second cutout 1524.

When the first driven wheel 15 rotates from the final position where the second cutout 1524 registers with the contact part of the first sensor switch 171 to the original position where the first cutout 1522 registers with the first sensor switch 171, the first sensor switch 171 is released and thus produces a signal for deactivating the motor 131. However, since the electronic control unit 17 will generate a signal for reversing the direction of the motor 131, the motor 131 will be driven to rotate in the opposite direction against its rotational inertia. Thus, a shorter length is required for the first cutout 1522. The arrangement as described is merely an example and should not be a limitation of the present invention. The first and second cutouts 1522 and 1524 may be provided with the same width, or the first cutout 1522 may be longer than the second cutout 1524 as desired.

Figure 14:
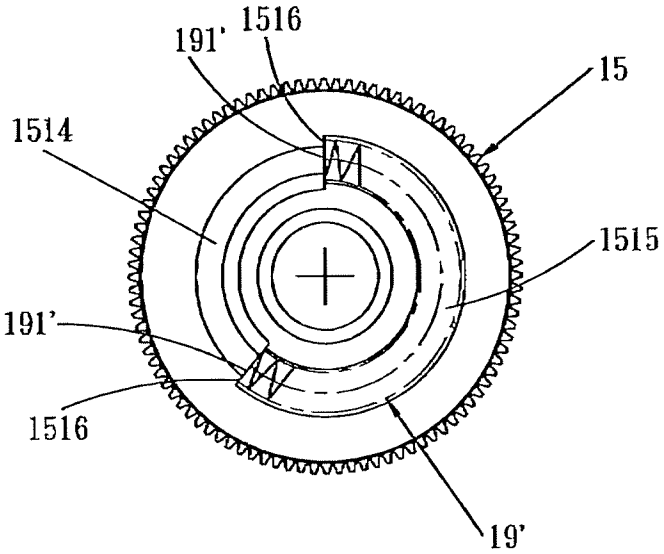
FIG. 14 shows a compression spring attached to the first driven wheel in place of a torsion spring.

Referring to FIG. 14, a compression spring 19' is attached to the first driven wheel 15 in place of the torsion spring 19, and has two end portions 191' abutting against the abutment faces 1516, respectively.

Referring to FIGS. 15-48, there is shown a second preferred embodiment of the electric door lock according to the present invention, which differs from the first preferred embodiment in that a mounting plate 5 and a third sensor switch 173 are additionally provided in the second embodiment and that the second driven wheel 16 in the second embodiment has a modified configuration.

The mounting plate 5 is mounted inside a door panel (not shown) opposite to the cover disc 31 of the outside lock unit 3. Two threaded bolts 51 are used to fix the mounting plate 5 and the cover disc 31 respectively at the inside and outside of the door panel (not shown).

The third sensor switch 173 is disposed in proximity to the second driven wheel 16. The third sensor switch 173 has a contact part 1731. The first sensor switch 171 has a contact part 1711, and the second sensor switch 172 has a contact part 1721.

The second driven wheel 16 in this embodiment is modified such that the second driven wheel 16 further has a first notch 1691, a second notch 1692 and the arcuate press part 160 in addition to the arcuate projection 167 and the arcuate cutout 168. The arcuate press part 160 is used as a sixth sensing element and is formed between the first and second notches 1691 and 1692. When the contact part 1731 of the third sensor switch 173 is registered with and pressed by the arcuate press part 160, the electronic control unit 17 will produce an alarm signal that the latch bolt has failed to function correctly, or has failed to move to its latching or unlatching position.

Figure 15:
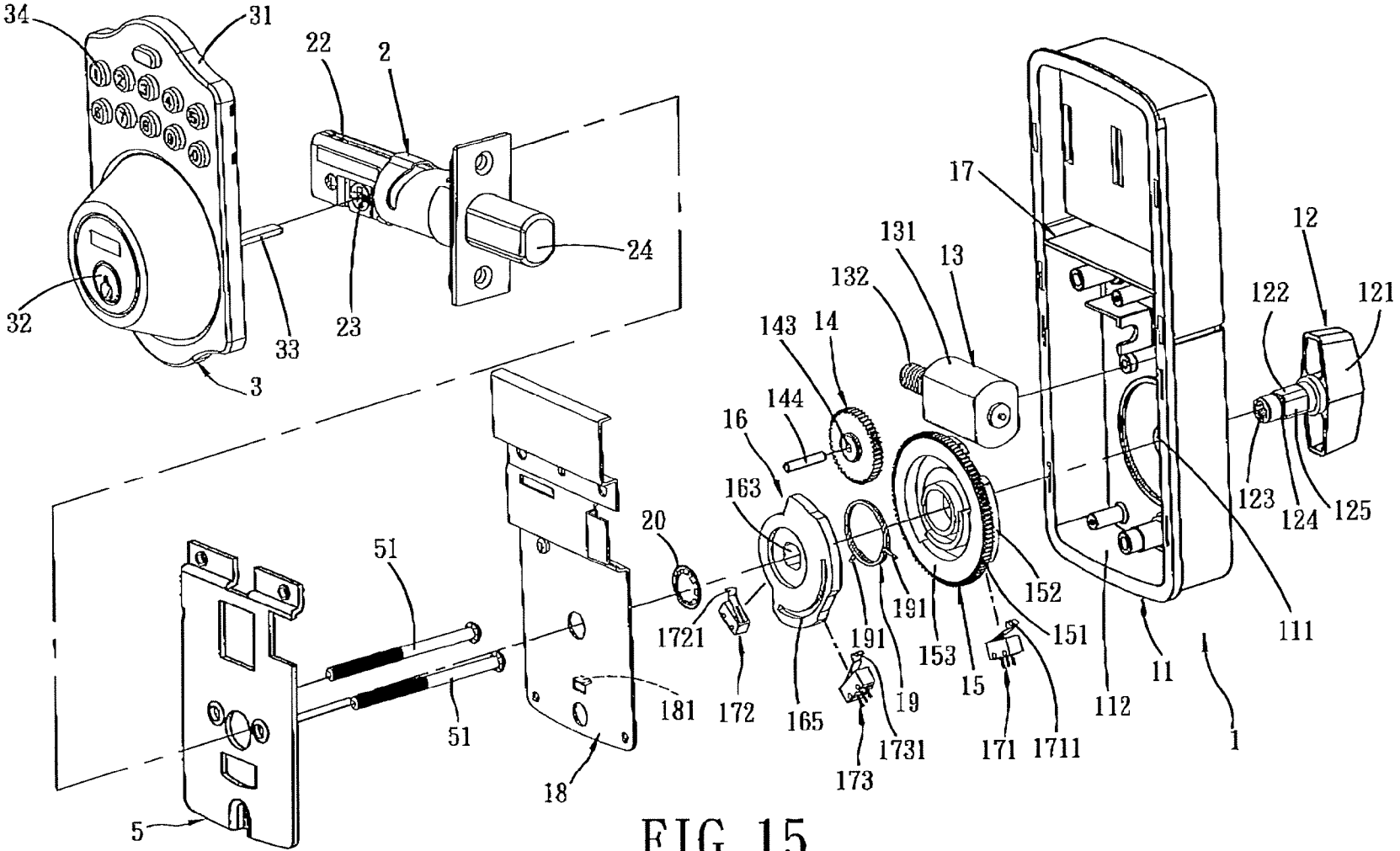
FIG. 15 is an exploded view of an electric door lock according to a second preferred embodiment of the present invention.
Figure 17:
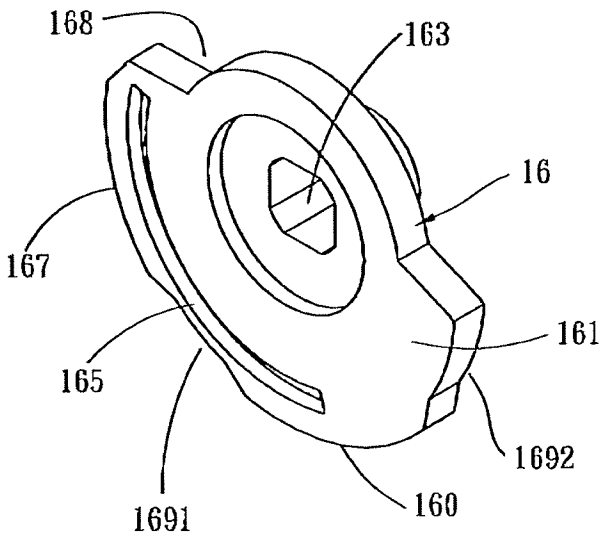
FIG. 17 is another perspective view of the second driven wheel of FIG. 15.
Figure 16:
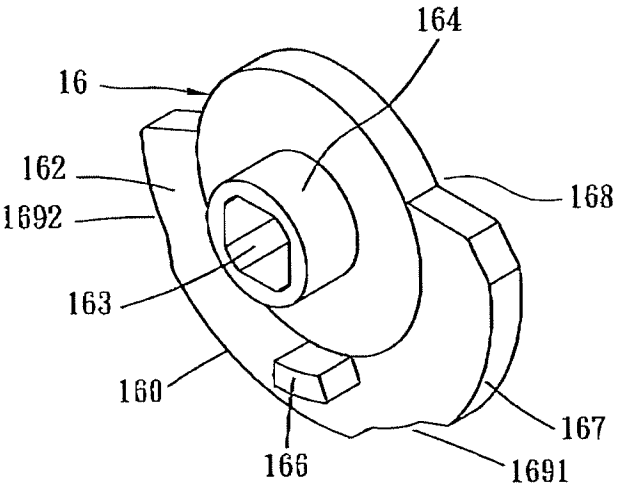
FIG. 16 is a perspective view of a second driven wheel of the electric door lock of FIG. 15.
Figure 18:
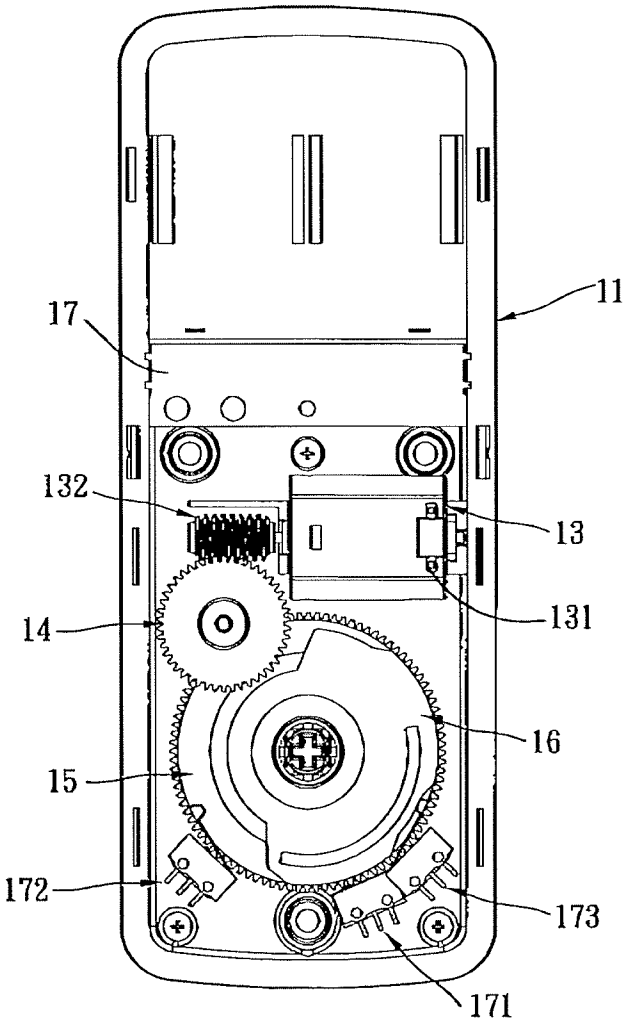
FIG. 18 is an elevation view showing the drive wheel and the first and second driven wheels of FIG. 15 in an assembled state.
Figure 19:
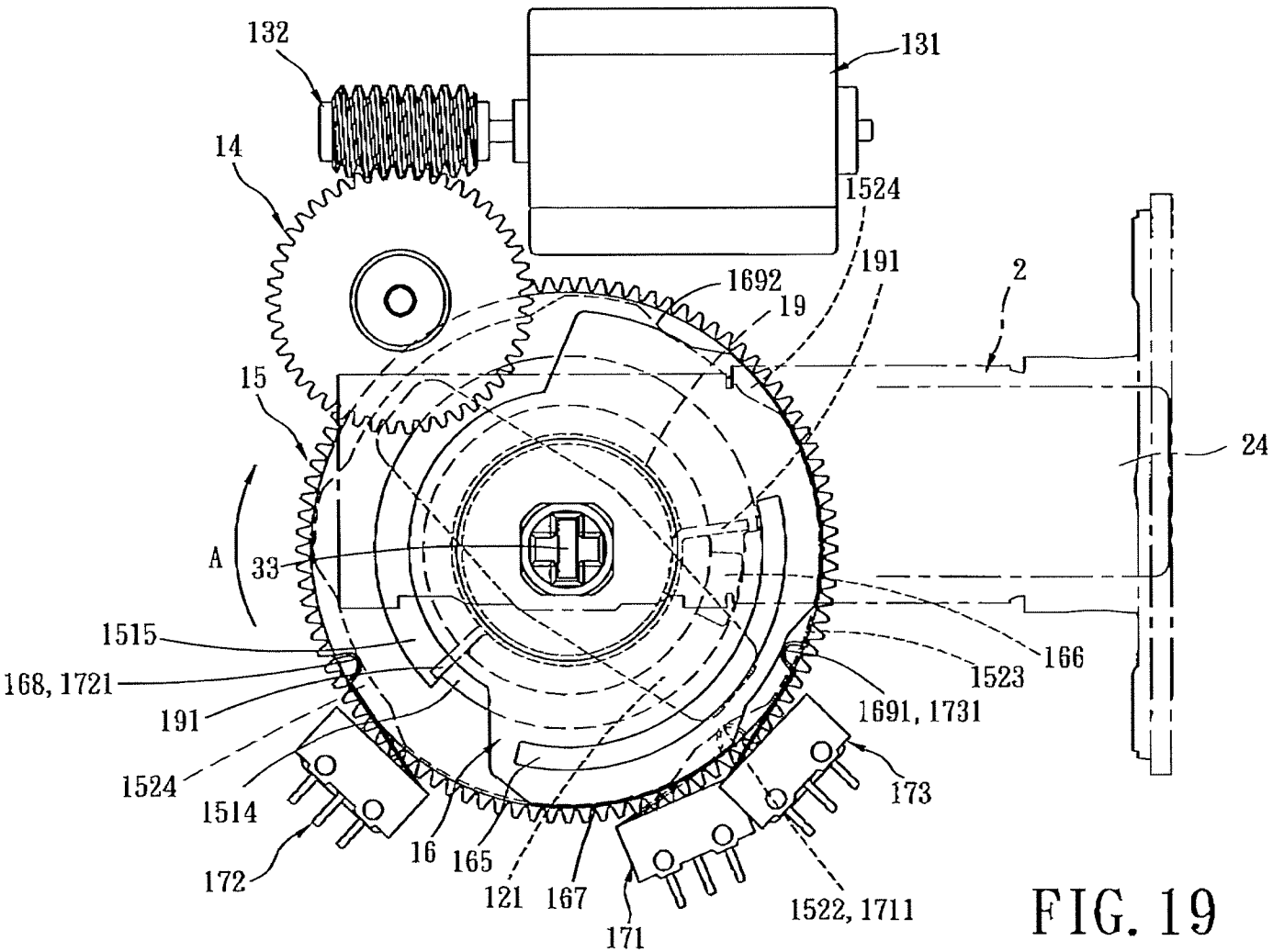
FIGS. 19-24 show different operation modes of the electric door lock of FIG. 15.
Figure 22:
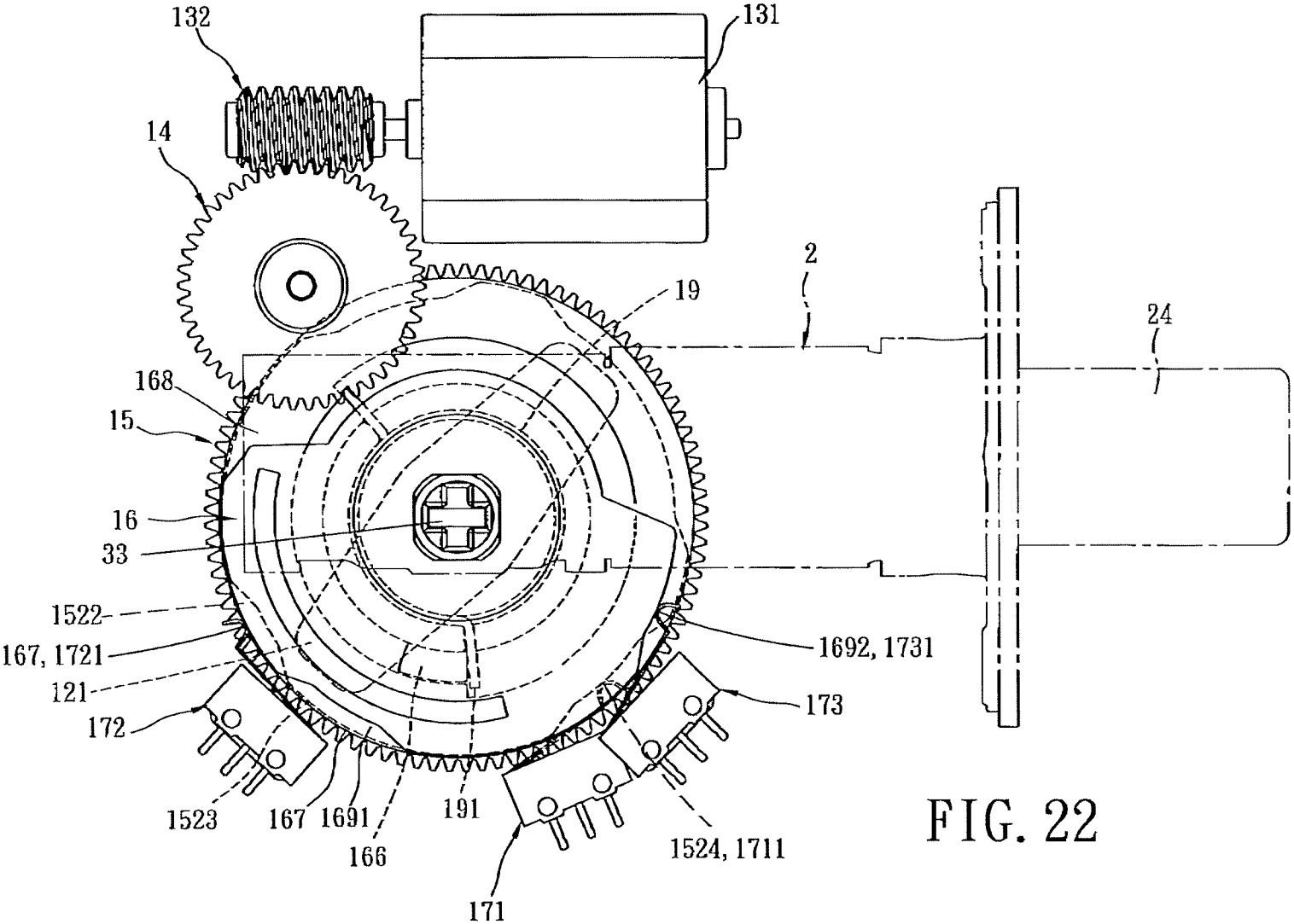

Referring to FIGS. 19 and 22 in combination with FIG. 15, the latch bolt 24 is moved from the unlatching position (FIG. 19) to the latching position (FIG. 22) by operating the controller input unit 34 (FIG. 15) so that the electronic control unit 17 activates the motor 131. When the arcuate cutout 168 of the second driven wheel 16 is registered with the contact part 1721 of the second sensor switch 172, the contact part 1721 of the second sensor switch 172 is not pressed. The first driven wheel 15 is rotated in the clockwise direction (A) from the original position so that one of the end portions 191 is moved in a direction towards the block 166. During the rotation of the first driven wheel 15, as the arcuate projection 1523 of the first driven wheel 15 is in contact with the contact part 1711 of the first sensor switch 171, the motor 131 is activated to rotate the first driven wheel 15 continuously. Therefore, the block 166 is pushed by the end portion 191 that moves to the block 166, thereby rotating the second driven wheel 16 clockwise and moving the second cutout 1524 of the first driven wheel 15 to the first sensor switch 171 as shown in FIG. 22. When the first sensor switch 171 is released by the second cutout 1524, the electronic control unit 17 deactivates the motor 131, the first driven wheel 15 stops at its final position (FIG. 22), and the latch bolt 24 reaches its latching position. At this state, the contact part 1731 of the third sensor switch 173 is registered with the second notch 1692 of the second driven wheel 16, indicating that the latch bolt 24 has actually reached its latching position. As soon as the latch bolt 24 has actually reached the latching position, the electronic control unit 17 controls the motor 131 to rotate in reverse so that the first driven wheel 15 rotates counterclockwise and moves back to its original position where the first cutout 1522 is aligned with the contact part 1711 of the first sensor switch 171 (FIG. 19).

Referring once again to FIGS. 20 and 21 in combination with FIG. 15, the latch bolt 24 is moved from the latching position (FIG. 20) to the unlatching position (FIG. 21) by operating the controller input unit (key set) 34 (FIG. 15) so that the electronic control unit 17 activates the motor 131. As the arcuate projection 167 of the second driven wheel 16 is registered with the contact part 1721 of the second sensor switch 172, the contact part 1721 of the second sensor switch 172 is pressed. Accordingly, the first driven wheel 15 is rotated in the counterclockwise direction (B) from the original position so that one of the end portions 191 is moved in a direction towards the block 166. During the rotation of the first driven wheel 15, as the arcuate projection 1523 of the first driven wheel 15 is in contact with the contact part 1711 of the first sensor switch 171, the motor 131 is activated to rotate the first driven wheel 15 continuously. Therefore, the block 166 is pushed by the end portion 191 that moves to the block 166, thereby rotating the second driven wheel 16 counterclockwise and moving the second cutout 1524 of the first driven wheel 15 to the first sensor switch 171 as shown in FIG. 21. When the contact part 1711 of the first sensor switch 171 is released by the second cutout 1524, the electronic control unit 17 deactivates the motor 131, the first driven wheel stops at its final position (FIG. 21), and the latch bolt 24 reaches its unlatching position. At this state, the contact part 1731 of the third sensor switch 173 is registered with the first notch 1691 of the second driven wheel 16, notifying that the latch bolt 24 has actually reached its unlatching position. As soon as the latch bolt 24 reaches the unlatching position, the electronic control unit 17 controls the motor 131 to rotate in reverse so that the first driven wheel 15 rotates clockwise and moves back to its original position where the first cutout 1522 is aligned with the contact part 1711 of the first sensor switch 171 (FIG. 19).

Figure 23:
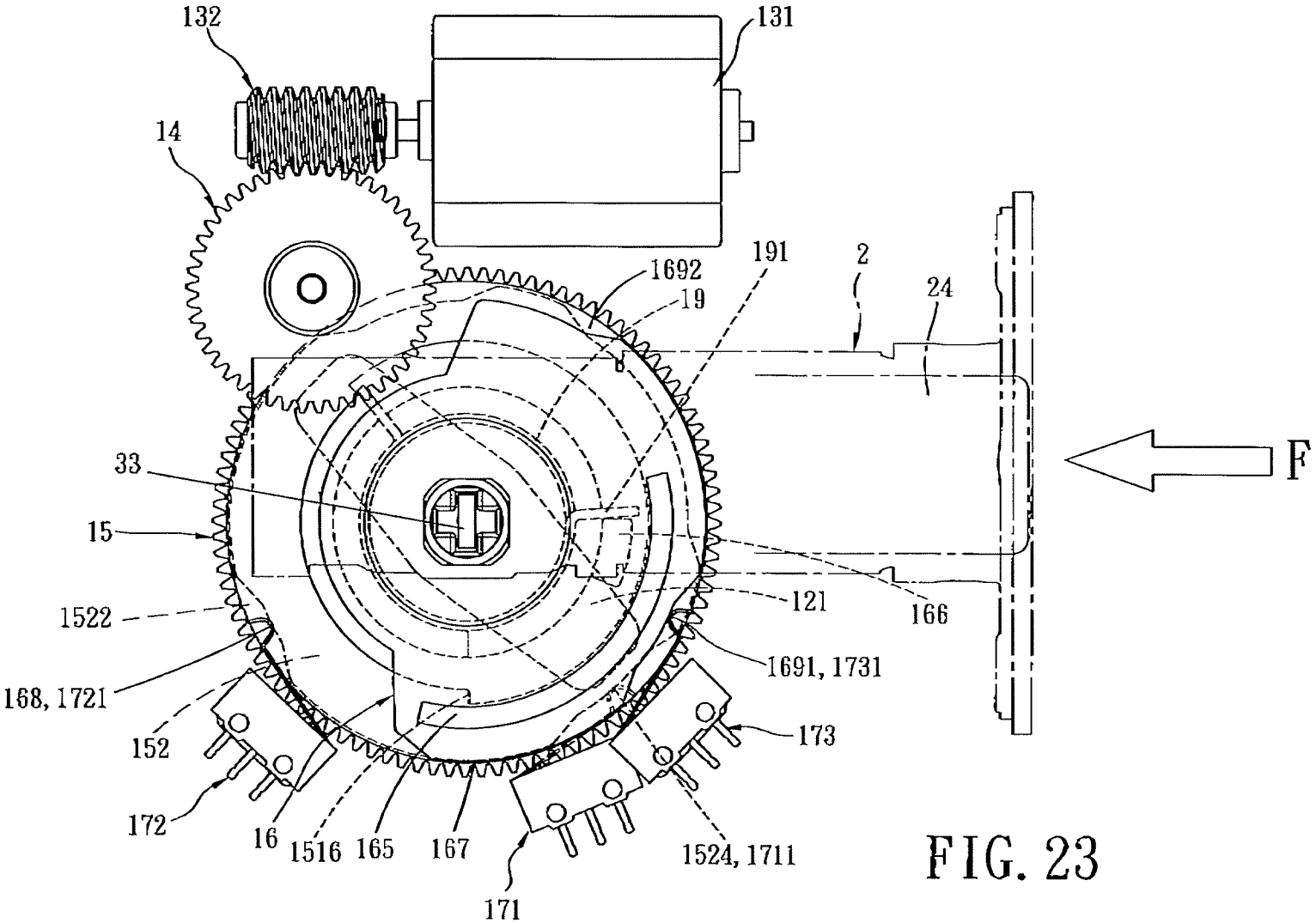

Referring to FIG. 23 in combination with FIGS. 15 and 19, when the motor 131 is activated to rotate clockwise the first driven wheel 15 for moving the latch bolt 24 to its latching position, the latch bolt 24 may be jammed by the obstruction force (F), which prevents it from moving to its latching position. Therefore, the block 166 becomes inoperative. However, because the end portion 191 is resiliently movable relative to the first driven wheel 15, the first driven wheel 15 is permitted to rotate clockwise without being obstructed. Rotation of the first driven wheel 15 stops when the contact part 1711 of the first sensor switch 171 is registered with and released by the second cutout 1524. At this state, because the arcuate cutout 168 stays registered with the contact part 1721 of the second sensor switch 172, the second sensor switch 172 does not detect the arcuate projection 167 or any positional change of the second driven wheel 16, and the latch bolt 24 does not move to its latching position. As a result, the electronic control unit 17 generates an error or alarm signal in terms of an audio or video signal to notify the user that the latch bolt 24 does not move to the latching position, or that the first driven wheel 15 must rotate counterclockwise to move to its first position where the first cutout 1522 is aligned with the contact part 1711 of the first sensor switch 171.

Figure 20:
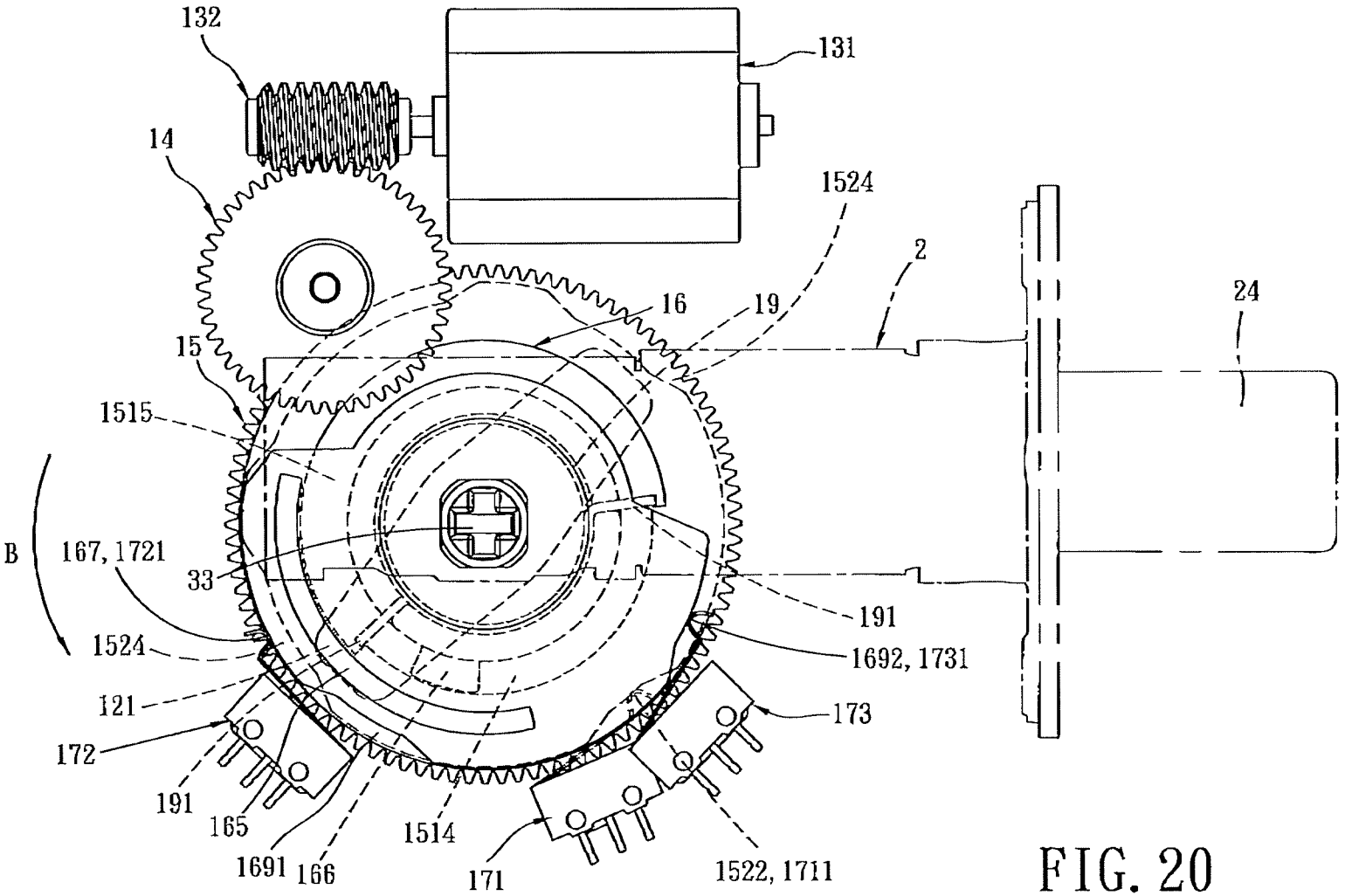
Figure 21:
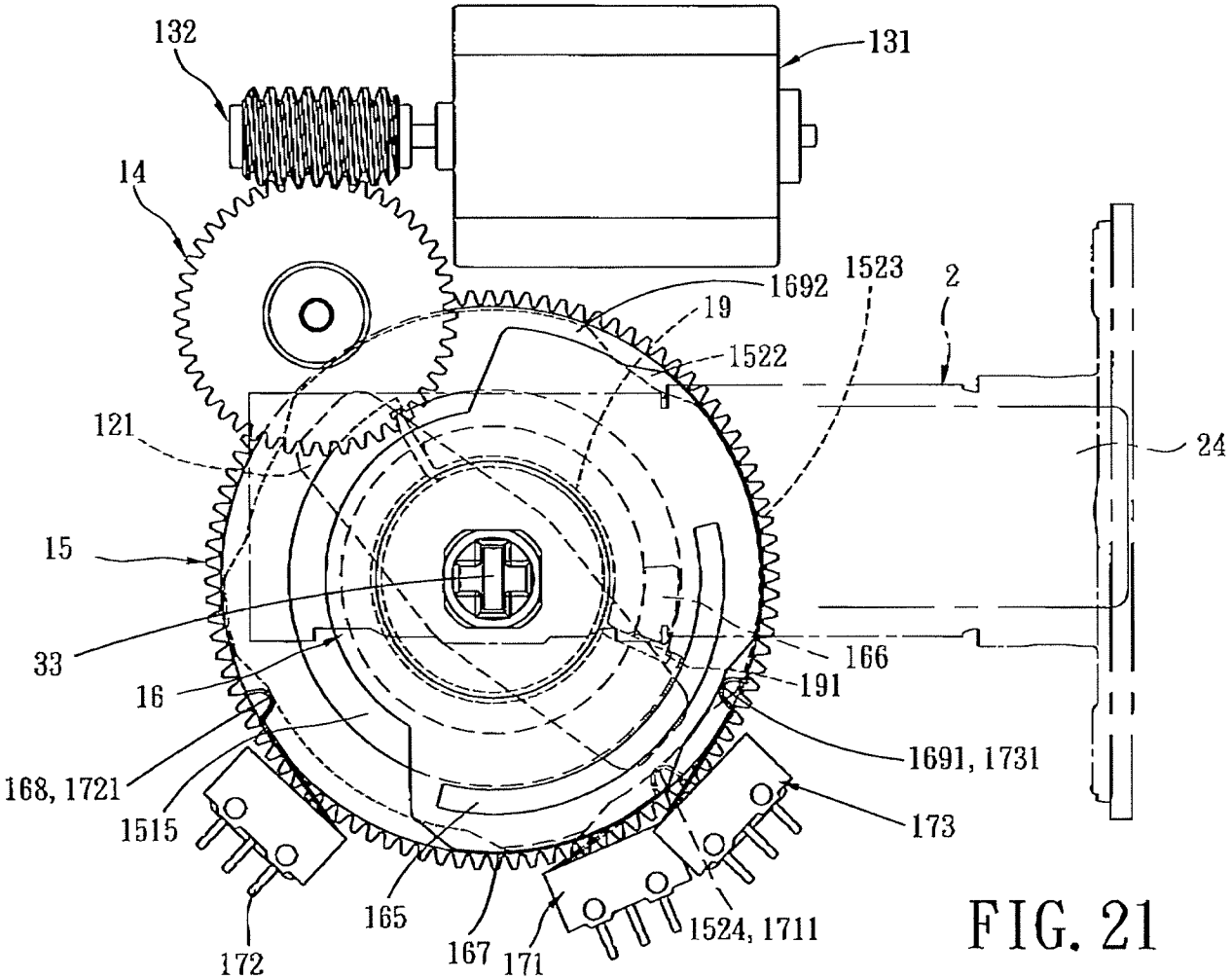
Figure 24:
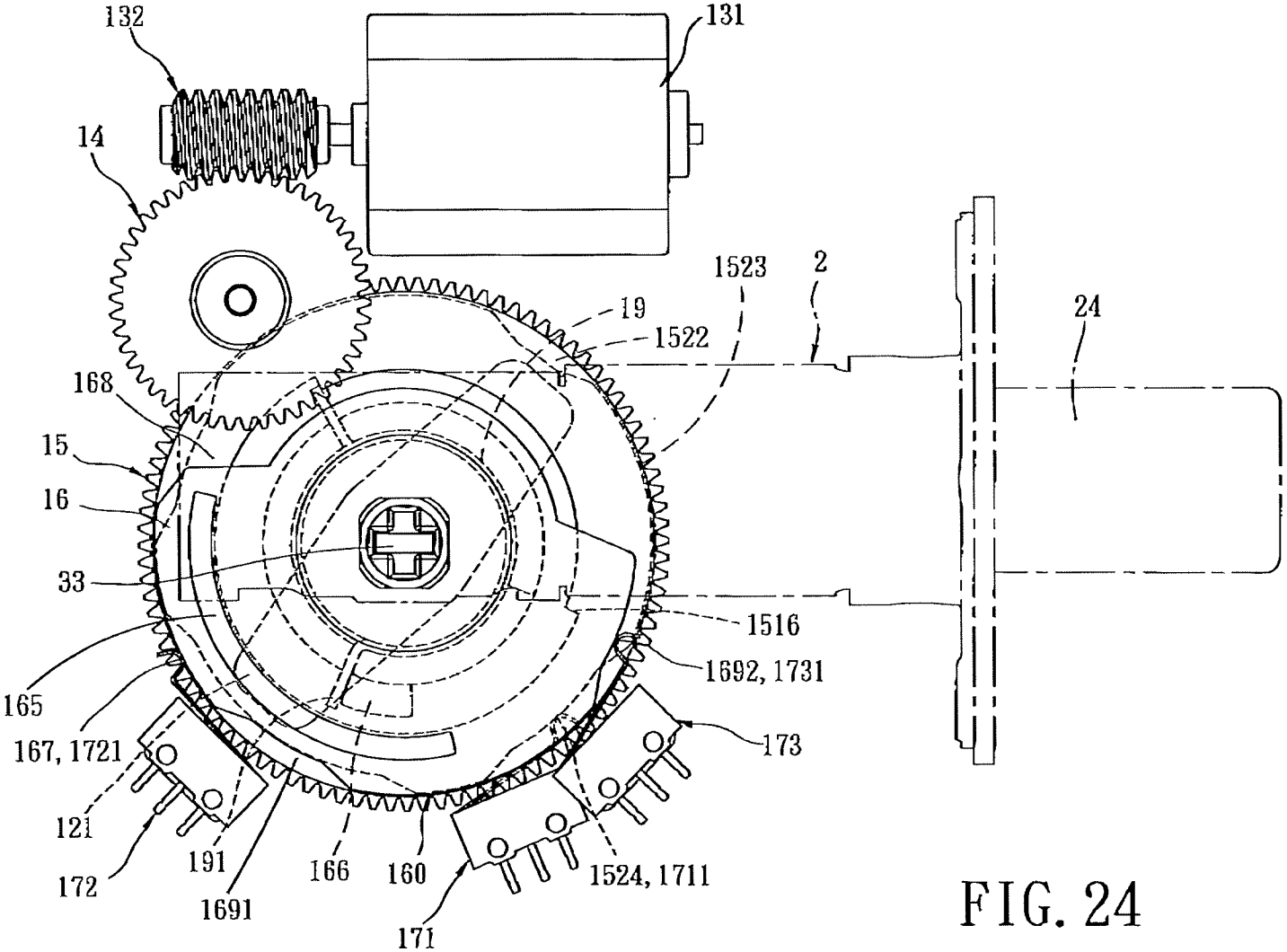

Referring to FIG. 24 in combination with FIGS. 15 and 20, when the first driven wheel 15 is rotated counterclockwise to move the latch bolt 24 from the latching position to the unlatching position, the latch bolt 24 may be jammed and prevented from moving to its unlatching position. Accordingly, the block 166 becomes inoperative. However, because the end portion 191 is resiliently movable relative to the first driven wheel 15, the first driven wheel 15 is permitted to rotate counterclockwise without being obstructed. Rotation of the first driven wheel 15 stops when the contact part 1711 of the first sensor switch 171 is registered with and released by the second cutout 1524. At this state, as the arcuate projection 167 stays registered with the contact part 1721 of the second sensor switch 172, the second sensor switch 172 does not detect the arcuate cutout 168 or any positional change of the second driven wheel 16, and the latch bolt 24 does not move to its unlatching position. As a result, the electronic control unit 17 generates an error or alarm signal.

Referring back to FIGS. 15 and 17, when the latch bolt 24 is subjected to an obstruction force and stops between its latching and unlatching positions, and when the second driven wheel 16 also stops its rotation, the arcuate press part 160 will press the contact part 1731 of the third sensor switch 173 and transmit a signal so that the electronic control unit 17 produces an error signal, which may be an audio or video signal.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangements.

We claim:

1. An electric door lock comprising: a drive unit having a motor; a first driven wheel connected drivenly to said drive unit, and having opposite first and second faces, a central hole extending through said first and second faces, and two angularly spaced apart abutment faces formed on said first face at positions that are spaced radially from said central hole; a spring attached to said first face of said first driven wheel and having two angularly spaced apart driving elements respectively abutting against said abutment faces by a biasing force of said spring, said driving elements being rotatable along with said first driven wheel; a latch unit; an operating unit to operate said latch unit and having a rotary handle; and a second driven wheel connected drivenly to said operating unit, said second driven wheel having a driven element extending to said first face of said first driven wheel and disposed between said driving elements so as to be pushed by one of said driving elements; said second driven wheel being rotatable between a first position that places said latch unit in an unlatching position and a second position that places said latch unit in a latching position; wherein, when said drive unit drives said first driven wheel, one of said driving elements pushes said driven element to rotate said second driven wheel from said first position to said second position and the other one of said driving elements pushes said driven element to rotate said second driven wheel from said second position to said first position.

2. The electric door lock of claim 1, wherein said spring has two angularly spaced apart end portions that are used as said driving elements.

3. The electric door lock of claim 2, wherein said spring is a torsion spring that has said end portions which are bent.

4. The electric door lock of claim 3, wherein said first driven wheel further has an arc-shaped groove formed in said first face between said end portions of said spring, said driven element being a block projecting from said second driven wheel into said arc-shaped groove.

5. The electric door lock of claim 4, wherein said first driven wheel further has an arc-shaped rib formed on said first face between said end portions of said torsion spring, said abutment faces being formed respectively on two opposite ends of said arc-shaped rib.

6. The electric door lock of claim 1, further comprising an electronic control unit connected to said motor and having a first sensor switch proximate to said first driven wheel, said first driven wheel being movable between an original position and a final position when said second driven wheel moves between said first and second positions, said first sensor switch detecting varying positions of said first driven wheel.

7. The electric door lock of claim 6, wherein said first driven wheel further has first and second cutouts that are formed circumferentially on said first driven wheel at different angular positions and that unpress said first sensor switch, and an arcuate projection between said first and second cutouts to press said first sensor switch.

8. The electric door lock of claim 6, wherein said electronic control unit further has a second sensor switch proximate to said second driven wheel to detect varying positions of said second driven wheel.

9. The electric door lock of claim 8, wherein said second driven wheel further has an arcuate projection and an arcuate cutout formed circumferentially on said second driven wheel at different angular positions, and said second sensor switch is pressed by said arcuate projection and unpressed by said arcuate cutout.

10. An electric door lock comprising: a drive unit having a motor, a first driven wheel connected drivenly to said motor, and having at least one resilient driving element; a latch unit; an operating unit to operate said latch unit and having a rotary handle; and a second driven wheel connected drivenly to said rotary handle, and having a driven element driven by said driving element; said driving element causing said second driven wheel and said driven element to rotate in a first angular direction when said first driven wheel is rotated in said first angular direction; said resilient driving element being pressed by said driven element when said first driven wheel rotates in said first angular direction and when said second driven wheel is obstructed from being rotated by said first driven wheel.

11. The electric door lock of claim 10, wherein said first driven wheel further has at least one abutment face, and a spring that is attached to said first driven wheel and that has an end portion acting as said resilient driving element, said end portion abutting against said abutment face by a biasing force of said spring.

12. The electric door lock of claim 11, wherein said first driven wheel has two said abutment faces, said spring being a torsion spring that has two said end portions, which are spaced apart angularly and which are bent, said end portions abutting against said abutment faces, respectively, said driven element being disposed between said end portions.

13. The electric door lock of claim 12, wherein said first driven wheel further has an arc-shaped groove between said end portions of said torsion spring, said driven element being a block that projects from said second driven wheel into said arc-shaped groove.

14. An electric door lock comprising: a drive unit having a motor; a first driven wheel connected drivenly to said drive unit, and having a driving element, said first driven wheel being rotatable between an original position and a final position; a latch unit; an operating unit to operate said latch unit and having a rotary handle; a second driven wheel connected drivenly to said rotary handle, said second driven wheel having a driven element to be moved by said driving element, said second driven wheel being rotatable-between a first position that places said latch unit in an unlatching position and a second position that places said latch unit in a latching position; an electronic control unit connected electrically to said motor, and having a first sensor switch proximate to said first driven wheel to detect varying positions of said first driven wheel, and a second sensor switch proximate to said second driven wheel to detect varying positions of said second driven wheel; said first driven wheel rotating between said original and final positions when said second driven wheel moves between said first and second positions; said electronic control unit activating or deactivating said motor based on a detected signal of said first sensor switch, and controlling of said motor to reverse a rotating direction thereof when said second sensor switch detects that said second driven wheel is obstructed from being rotated by said first driven wheel to change in position.

15. The electric door lock of claim 14, wherein said first driven wheel further has first, second and third sensing elements which are disposed circumferentially on said first driven wheel at different angular positions, said first sensor switch detecting said first sensing element when said first driven element wheel is in said original position and detecting said second sensing element when said first driven wheel is in said final position, said third sensing element being disposed between said first and second sensing elements.

16. The electric door lock of claim 14, wherein said second driven wheel further has fourth and fifth sensing elements to be detected by said second sensor switch.

17. The electric door lock of claim 16, wherein said second driven wheel further has an arcuate projection and an arcuate cutout that are formed circumferentially on a periphery of said second driven wheel at different angular positions and that are used as said fourth and fifth sensing elements, respectively.

18. The electric door lock of claim 17, wherein said electronic control unit further includes a third sensor switch proximate to said second driven wheel, said second driven wheel further has a sixth sensing element to be detected by said third sensor switch, and said electronic control unit produces an alarm signal that said latch bolt does not correctly move to said latching or unlatching position based on a detected signal of said third sensor switch.

19. The electric door lock of claim 18, wherein said second driven wheel further has an arcuate press part formed on said periphery of said second driven wheel to be used as said sixth sensing element.

20. An electric door lock comprising: a drive unit having a motor; a first driven wheel connected drivenly to said drive unit, and having two axially opposite faces, a central hole extending through said opposite faces, and an arc-shaped rib that is formed on one of said faces around said central hole and that has two angularly spaced apart ends respectively formed with abutment faces; a spring that is attached to said one face of said first driven wheel, that is spaced apart from and around said central hole, and that is disposed between said abutment faces, said spring having two angularly spaced apart end portions abutting against said abutment faces, respectively; a latch unit; an operating unit to operate said latch unit and having a rotary handle; and a second driven wheel connected drivenly to said operating unit, said second driven wheel having a driven element extending to said one face of said first driven wheel and disposed between said end portions of said spring; said second driven wheel being movable between a first position that places said latch unit in an unlatching position and a second position that places said latch unit in a latching position; one of said end portions of said spring pushing said driven element to rotate said second driven wheel from said first position to said second position, the other one of said end portions of said spring pushing said driven element to rotate said second driven wheel from said second position to said first position.

21. The electric door lock of claim 20, wherein said spring is a torsion spring.

22. An electric door lock comprising: a drive unit having a motor; a first driven wheel connected drivenly to said drive unit, and including two axially opposite faces, a central hole extending through said opposite faces, an arc-shaped groove formed in one of said faces around said central hole, and two angularly spaced apart abutment faces that are proximate to two angularly opposite ends of said arc-shaped groove, respectively; a spring that is attached to said one face of said first driven wheel, and that is spaced apart from and around said central hole, said spring having two angularly spaced apart end portions abutting against said abutment faces, respectively; a latch unit; an operating unit to operate said latch unit and having a rotary handle; and a second driven wheel connected drivenly to said operating unit, said second driven wheel having a driven element extending into said arc-shaped groove and between said end portions of said spring; said second driven wheel being movable between a first position that places said latch unit in an unlatching position and a second position that places said latch unit in a latching position; one of said end portions pushing said driven element to rotate said second driven wheel from said first position to said second position, the other one of said end portions pushing said driven element to rotate said second driven wheel from said second position to said first position.

* * * * *